US009670687B2

(12) United States Patent
van der Meijden et al.

(10) Patent No.: US 9,670,687 B2
(45) Date of Patent: Jun. 6, 2017

(54) OMNIDIRECTIONAL AUTOMATIC SWIMMING POOL CLEANERS

(71) Applicant: ZODIAC POOL SYSTEMS, INC., Vista, CA (US)

(72) Inventors: Hendrikus Johannes van der Meijden, Midrand (ZA); Michael Edward Moore, Blairgowrie (ZA); Bruce David Harbottle, Johannesburg (ZA)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 512 days.

(21) Appl. No.: 14/254,111

(22) Filed: Apr. 16, 2014

(65) Prior Publication Data

US 2014/0310894 A1 Oct. 23, 2014

Related U.S. Application Data

(60) Provisional application No. 61/812,755, filed on Apr. 17, 2013.

(51) Int. Cl.
*E04H 4/16* (2006.01)

(52) U.S. Cl.
CPC ..... *E04H 4/16* (2013.01); *E04H 4/1654* (2013.01); *E04H 4/1663* (2013.01)

(58) Field of Classification Search
CPC ..... E04H 4/16; E04H 4/1654; E04H 4/1663
See application file for complete search history.

(56) References Cited

U.S. PATENT DOCUMENTS

| | | | | |
|---|---|---|---|---|
| 3,321,787 | A * | 5/1967 | Myers | A47L 11/00 15/1.7 |
| 3,324,492 | A * | 6/1967 | Myers | A47L 11/00 15/1.7 |
| 4,521,933 | A | 6/1985 | Raubenheimer | |
| 4,536,908 | A | 8/1985 | Raubenheimer | |
| 4,742,593 | A | 5/1988 | Kallenbach | |
| 5,014,382 | A | 5/1991 | Kallenbach | |
| 5,093,950 | A | 3/1992 | Heier | |
| 5,379,473 | A | 1/1995 | Rief et al. | |
| 5,706,539 | A | 1/1998 | Fukuda | |
| 5,802,653 | A | 9/1998 | Roumagnac et al. | |
| 6,237,175 | B1 * | 5/2001 | Phillipson | E04H 4/1663 15/1.7 |
| 6,463,614 | B1 * | 10/2002 | Supra | E04H 4/1663 15/1.7 |

(Continued)

FOREIGN PATENT DOCUMENTS

FR 2635068 A1 2/1990

OTHER PUBLICATIONS

U.S. Appl. No. 14/205,408, filed Mar. 12, 2014.

(Continued)

*Primary Examiner* — Randall Chin
(74) *Attorney, Agent, or Firm* — Kilpatrick Townsend & Stockton LLP; Dean W. Russell

(57) ABSTRACT

Automatic pool cleaners (APCs) and components thereof are detailed. The APCs may turn feet, rather than entire bodies, to change direction and may provide water-flow paths through the bodies that are oriented vertically. Thus, unlike existing disc-based cleaners, the APCs may reduce influence of connected hoses on their movements within pools.

12 Claims, 8 Drawing Sheets

(56) References Cited

U.S. PATENT DOCUMENTS

2007/0056124 A1 3/2007 Wichmann

OTHER PUBLICATIONS

International Search Report and Written Opinion dated Nov. 4, 2014 in Application No. PCT/US2014/034297.
European Patent Application No. 16171510.7, Extended European Search Report, mailed Sep. 26, 2016, 8 pages.

* cited by examiner

OMNIDIRECTIONAL AUTOMATIC SWIMMING POOL CLEANERS

CROSS-REFERENCE TO RELATED APPLICATION

This application claims the benefit of and priority to U.S. Provisional Patent Application No. 61/812,755, filed Apr. 17, 2013, entitled "Suction Pool Cleaner," the entire contents of which are incorporated herein by this reference.

FIELD OF THE INVENTION

This invention relates to equipment and methods for cleaning water of vessels such as swimming pools and spas and more particularly, although not necessarily exclusively, to automatic cleaners whose bodies need not necessarily turn in use and are less subject to directional influence of attached hoses, thus allowing the cleaners to, among other things, move and collect debris omnidirectionally.

BACKGROUND OF THE INVENTION

Conventionally, an automatic pool cleaner ("APC") may be considered either "hydraulic" or "electric" depending on the source of energy employed to effect its movement within a pool, spa, or other water-containing vessel. "Electric" cleaners, sometimes also called "robots," typically use electricity to power motors used to drive wheels or treads to allow the cleaners to move throughout the vessel. Although on-board batteries are sometimes considered to supply electricity to the robots, more likely electricity from mains outside the vessels is conveyed via electrical cords to the robots within the vessels.

"Hydraulic" cleaners, by contrast, connect to external pumps and utilize water flow caused by operation of the pumps to effect their movement within a pool or spa. Some hydraulic cleaners connect to pump outlets; these devices are called "pressure-side" APCs, as pressurized water from pump outlets typically drives the cleaners. Alternatively, hydraulic cleaners may connect to inlets of pumps. These "suction-side" cleaners often include valves and supporting structure designed periodically to interrupt water flow through their bodies to the pumps. Periodic flow interruption creates a "water-hammer" effect, with the resulting energy used to move the APCs within pools.

U.S. Pat. No. 4,742,593 to Kallenbach discloses exemplary valves useful in water-interruption, suction-side hydraulic APCs. A flexible-walled, "diaphragm" valve of the Kallenbach '593 patent may be placed within a chamber of a body of an APC, with the chamber filling with water upon immersion of the APC within a pool. As noted therein:

Expansion of the valve and release for it to reassume its relaxed condition is by the creation of a pressure differential across the valve member walls, i.e., a pressure difference between the chamber and the interior of the valve member. This is created by the suction [of the external pump]. The valve is autonomously opened and closed. Applied suction initially causes the valve to open; but with water flow established, the pressure within [the] valve drops below that of [the] chamber. The valve thus closes. The cycle autonomously repeats.

See Kallenbach '593 at col. 2, 1. 64 to col. 3, 1. 6 (numerals omitted).

U.S. Pat. No. 5,014,382 to Kallenbach illustrates an exemplary suction-side APC in which, for example, a valve of the Kallenbach '593 patent may be positioned. As shown in the Kallenbach '382 patent, the APC includes a flexible disc designed periodically to contact the surface to be cleaned as well as a body and an extension pipe both having a water-flow passage therethrough. Well depicted in the sole FIGURE of the Kallenbach '593 patent is that, when the flexible disc contacts a pool floor or other generally horizontal surface, water flows through the water-flow passage at an angle of approximately forty-five degrees thereto. A flexible hose connected to the end of the extension pipe remote from the disc continues to convey the water toward an inlet of a pump.

Combined with the acutely-angled flow path, the water-hammer effect provided by the interrupt valve tends to lead the APC in the direction of the horizontal vector component of the flow path. The result is that the APC effectively "follows" the hose, decreasing the randomness of movement of the APC along the pool floor and thus inhibiting cleaner of the entire floor. Similarly, by "following" the hose with its movement, the APC may be led into a corner of a pool or behind an obstacle with no automatic means of escape.

SUMMARY OF THE INVENTION

The present invention provides APCs with both flexible discs and water flow paths oriented perpendicularly (or approximately so) to pool floors or other surfaces contacted by the discs. As a consequence, the flow path through a body of such an APC is substantially vertical, so that no material horizontal vector of the water flow within the body exists. This change dramatically reduces influence of a connected hose upon movement of the body within a pool or spa, as no longer can the hose lead the APC in any substantial way.

Absent leadership by connected hoses, no mechanism exists to move conventional disc-containing, suction-side APCs within pools. The present invention hence also provides movement means for the APCs. Presently preferred is that such movement means comprise collapsible feet formed as part of, or directly or indirectly connected to, the APC bodies. The feet may be oriented at a small angle (e.g. twenty degrees) to the pool floor and collapse slightly about a hinge point at their bases so as to produce horizontal movement of the bodies. Operation of the diaphragm or other water-interrupt valve of an APC causes collapse and straightening of the feet at the valve frequency, with each cycle producing "forward" movement of the cleaner.

Moreover, the feet may be arrayed circularly (or substantially so) on an underside of the body of the APC and pivotable about a (vertical) axis generally perpendicular to the disc and pool floor. Some or all of the feet may be linked one to another so that they may be rotated or otherwise moved together and may point in the same direction for movement. This array of rotatable feet further lowers the energy needed to alter direction of the APC, as the entire APC need not be turned around the hose. Instead, any desirable direction of the APC may be achieved merely by changing the direction of the array of feet.

Preferred feet are largely rigid, with softer, rubber-like tips present where they contact floor of pools and spas. Each foot may be hinged at its base about an axis intended to be generally parallel to the pool floor when the APC is in use. Stops may be employed to limit the hinging movement.

As noted earlier, when extended to its most vertical position relative to the pool floor, contact angle of a foot with the floor relative to the hinge preferably is approximately ten degrees. Conversely, the contact angle when a foot is collapsed is preferably approximately twenty-five degrees. Of course, persons skilled in relevant fields will understand that neither contact angle is critical and thus may differ from the preferred values identified herein. A compression spring or other means may bias each foot toward its extended position.

One manner of interconnecting the arrayed feet is by mounting each hinge on a circular flange, mounting each flange on a circular gear, and engaging each circular gear by a master circular gear. Rotation axes of both the circular gears and the master circular gear are designed to be perpendicular to the pool floor when the APC is in use, and each foot may rotate about the rotation axis of its corresponding circular gear. By mechanically or electrically turning either a foot or the master circular gear, all of the arrayed feet are turned. Alternatively, feet of the array may communicate electrically with a controller able to command rotation or collapse (or both) of the feet via electrical signals.

Features of the invention thus include (but are not limited to) turning feet, rather than entire bodies, of APCs, collecting debris on a pool floor omnidirectionally, and providing water-flow paths through bodies of disc-based APCs that are essentially vertically oriented. APCs consistent with the present invention need not have any discernible "fronts," "rears," or "sides," although they may have fronts, rears, and sides if desired. Their structures additionally may minimize, if not substantially avoid, movement as influenced by connected hoses.

It thus is an optional, non-exclusive object of the present invention to provide disc-based APCs that, when in use, have water flow paths oriented substantially perpendicularly to pool floors.

It is another optional, non-exclusive object of the present invention to provide such APCs that are not, or are only minimally, influenced in their movement by connected hoses.

It is a further optional, non-exclusive object of the present invention to provide APCs with movement means in the form of collapsible feet.

It is also an optional, non-exclusive object of the present invention to provide means for mechanically or electrically linking some or all of the feet so that they rotate simultaneously.

It is, moreover, an optional, non-exclusive object of the present invention to provide APCs that need not have any discernible fronts, rears, and sides and that may collect debris from a pool floor omnidirectionally.

Other objects, features, and advantages of the present invention will be apparent to persons skilled in the relevant art with reference to the remaining text and the drawings of this application.

DETAILED DESCRIPTION

Figure 1:
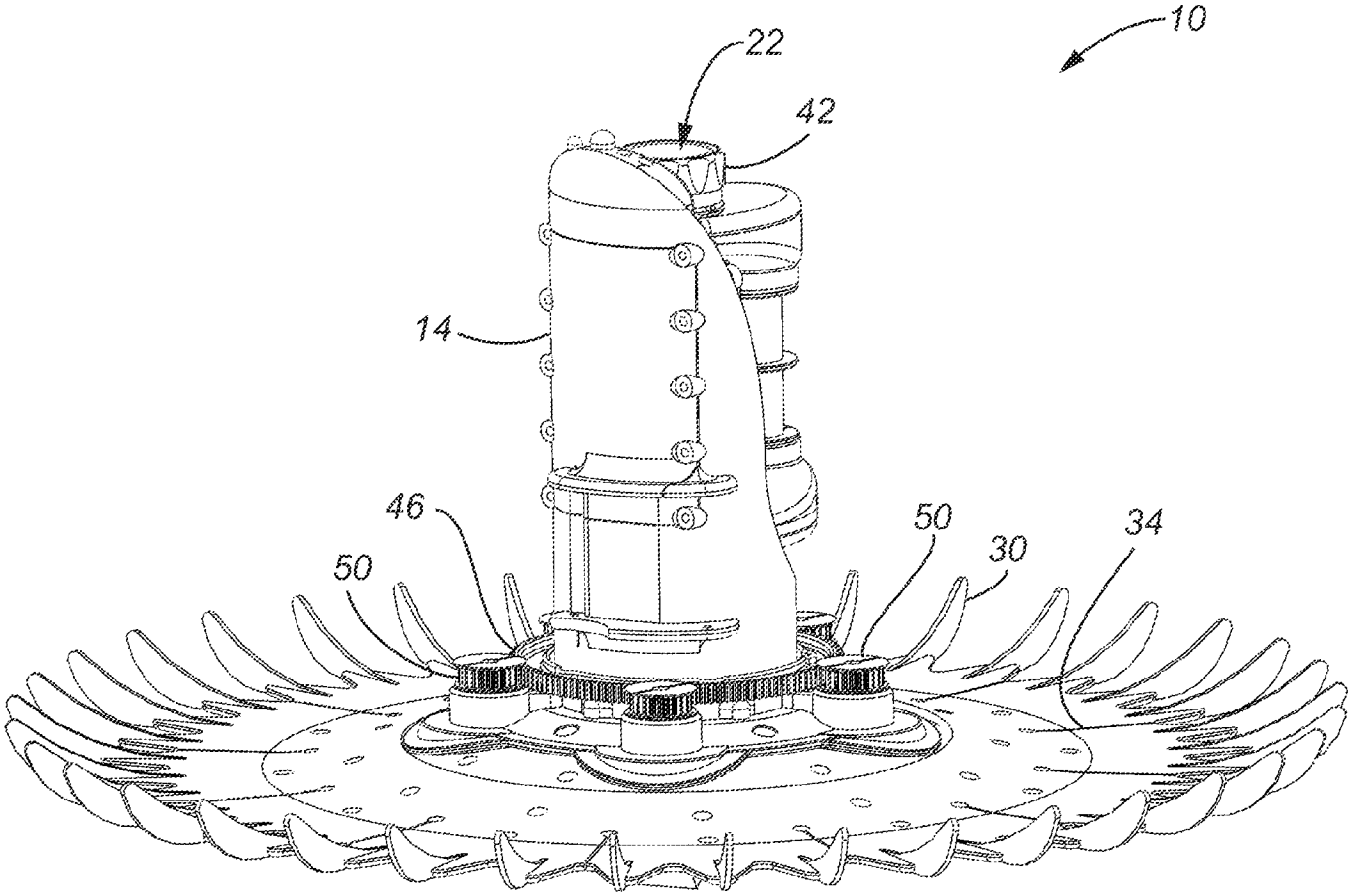
FIG. 1 is a perspective view of an exemplary APC of the present invention.

Illustrated especially in FIG. 1 is exemplary APC 10 of the present invention. APC 10 may include body 14 having inlet 18 (see FIG. 3) and outlet 22. Directly or indirectly connected to body 14 in conventional (or other) manner may be disc 26. Although disc 26 is shown as having features including fins 30 and slits 34 and being generally annular, it may be sized, shaped, and featured in any suitable way. Preferably, though, underside 38 of disc 26 is, in predominant part, planar (or substantially so).

Body 14 preferably includes a ring or fitting 42. Although not shown in the drawings, a hose typically may be attached to fitting 42 so as to convey—to a debris filter or elsewhere—water exiting outlet 22. Fitting 42 desirably allows the hose to swivel (rotate) relative to body 14, as is conventional.

Figure 2:
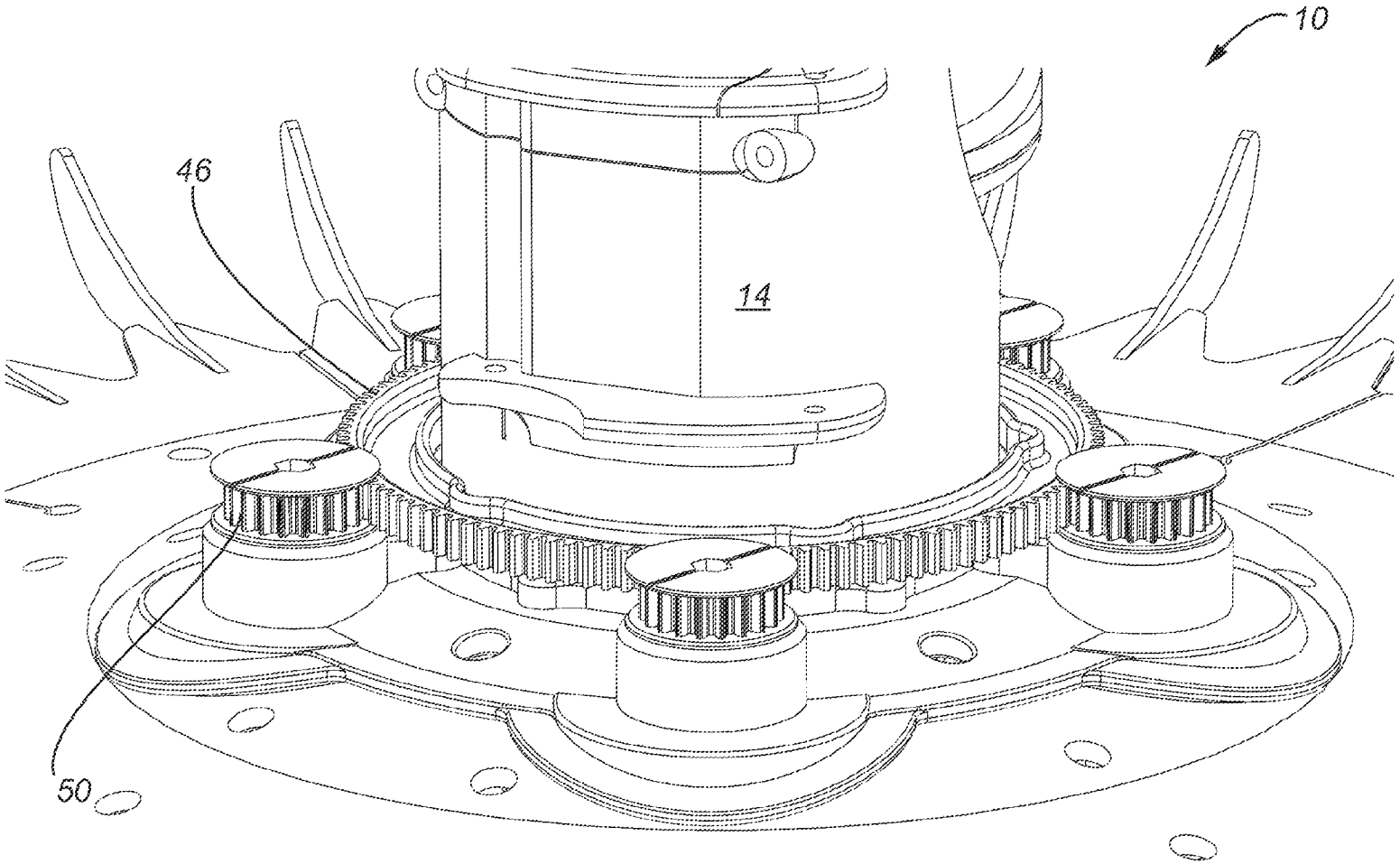
FIG. 2 is another perspective view of portions of the APC of FIG. 1.
Figure 3:
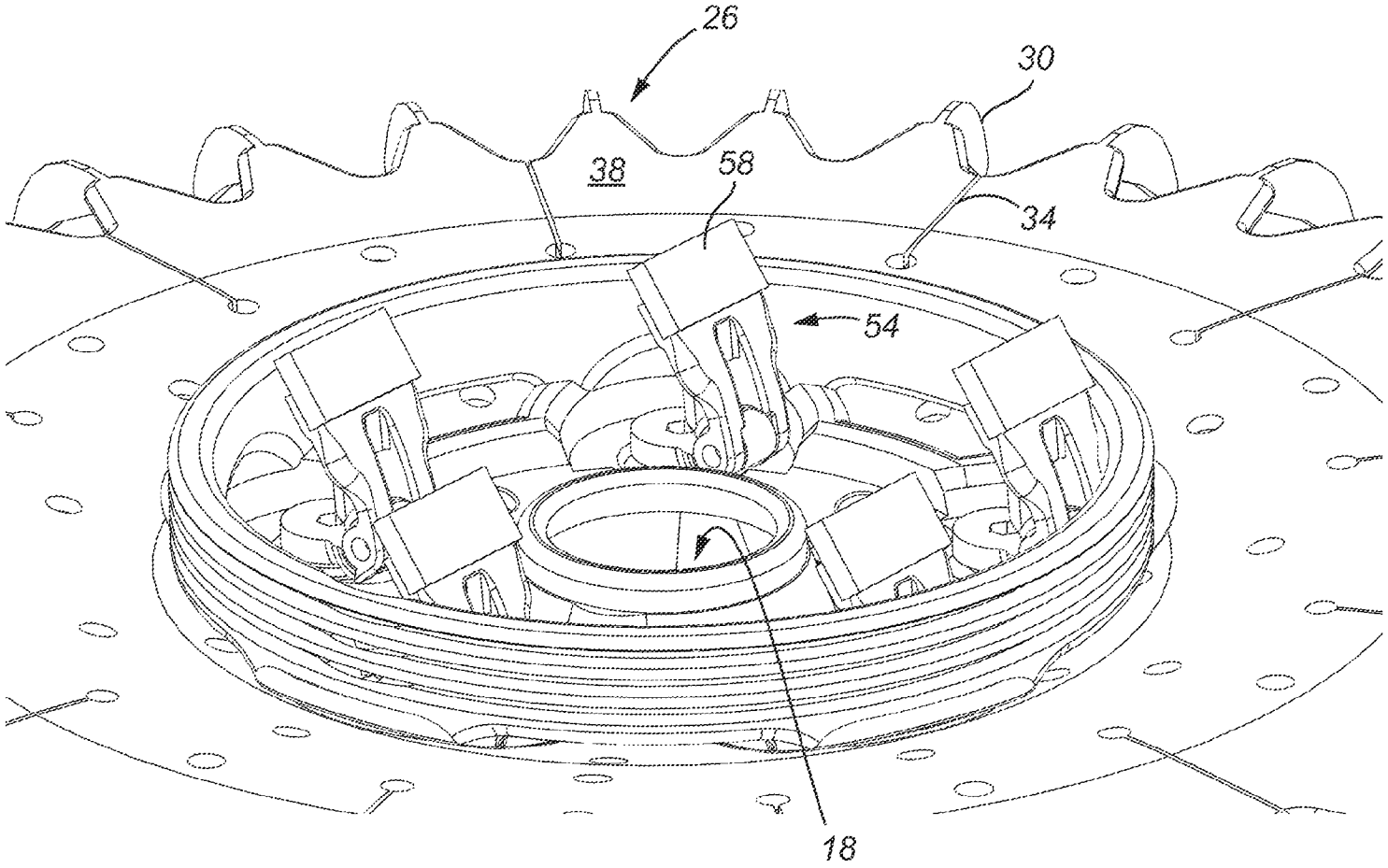
FIG. 3 is a view of the underside of the APC of FIG. 1.

Clear from FIGS. 1-3 is that, if underside 38 is contacting a generally horizontal surface such as a pool floor, the water flow path between inlet 18 and outlet 22 will be generally vertical—i.e. generally perpendicular to the pool floor. This may be contrasted with the corresponding flow path of the APC of the Kallenbach '382 patent, for example, which forms an angle of approximately forty-five degrees to the floor. Because of this angle, valve closure contracting a hose associated with the APC of the Kallenbach '382 patent will move the cleaner to the right of the page in the sole FIGURE, whereas valve closure within body 14 causing contraction of an associated hose likely will not.

Figure 4:
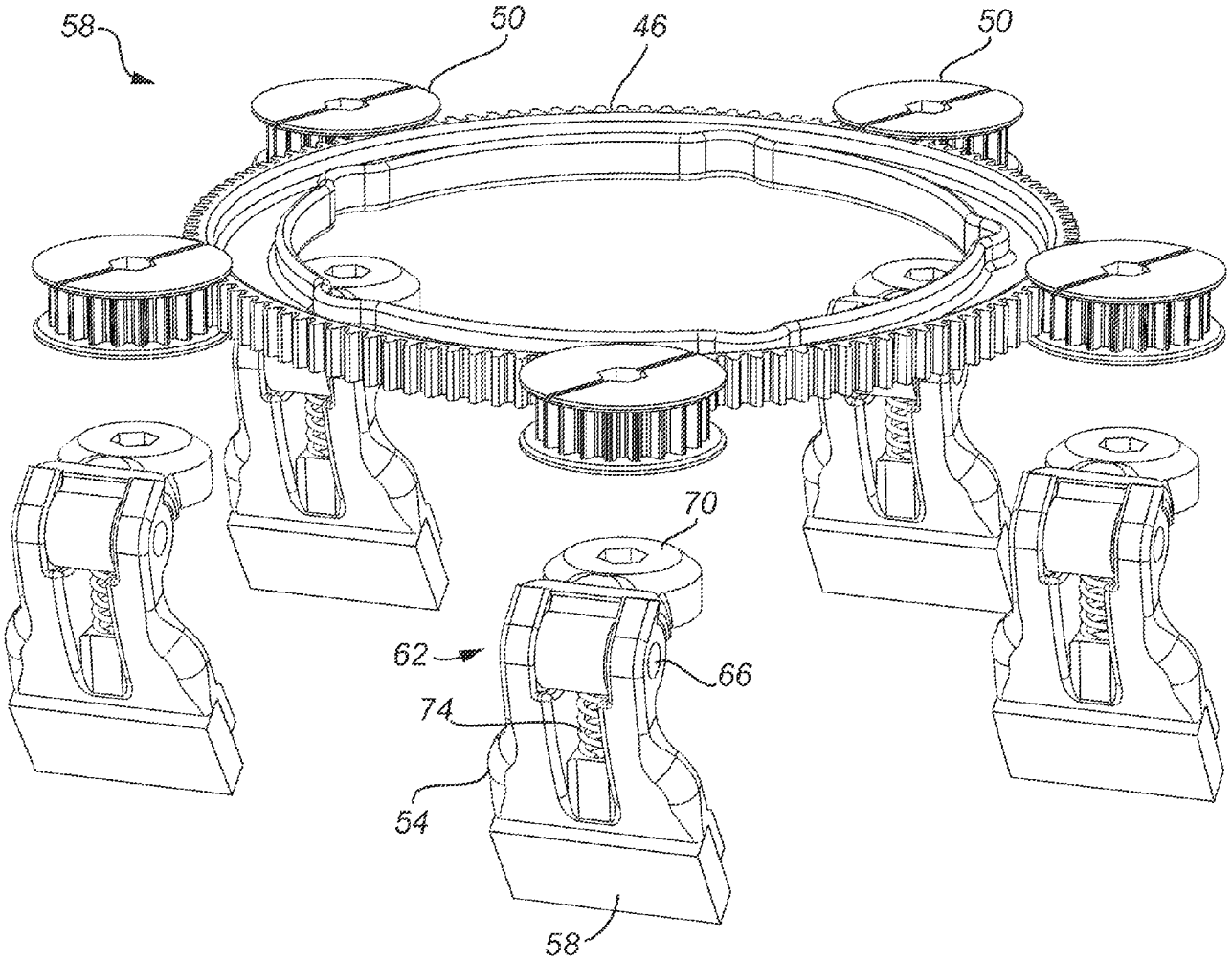
FIG. 4 is a partially-exploded, perspective view of exemplary feet and other components of the APC of FIG. 1.
Figure 5A:
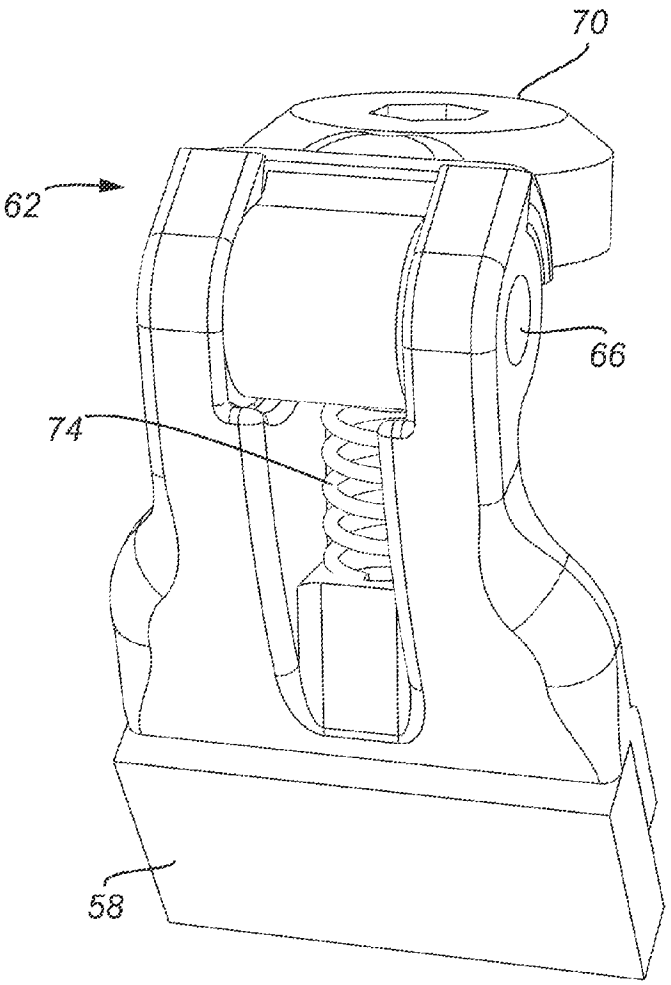
FIGS. 5A-D are various perspective, elevational, and cross-sectional views of a foot consistent with the feet of FIG. 4.
Figure 5B:
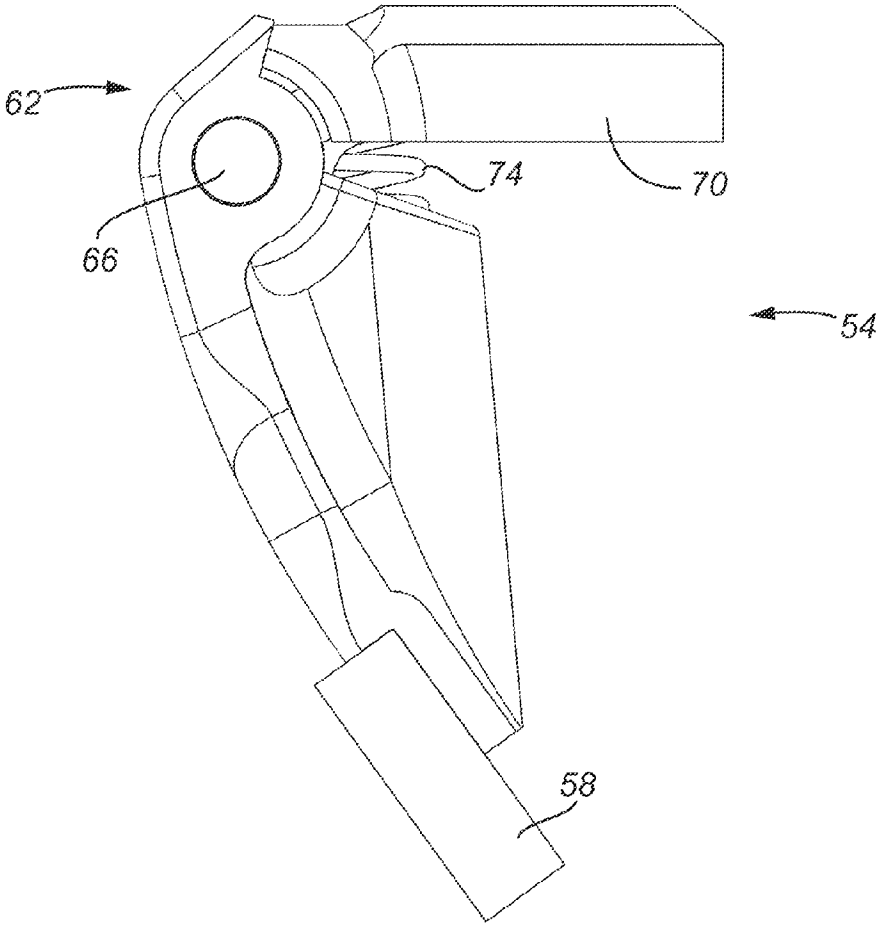
Figure 5C:
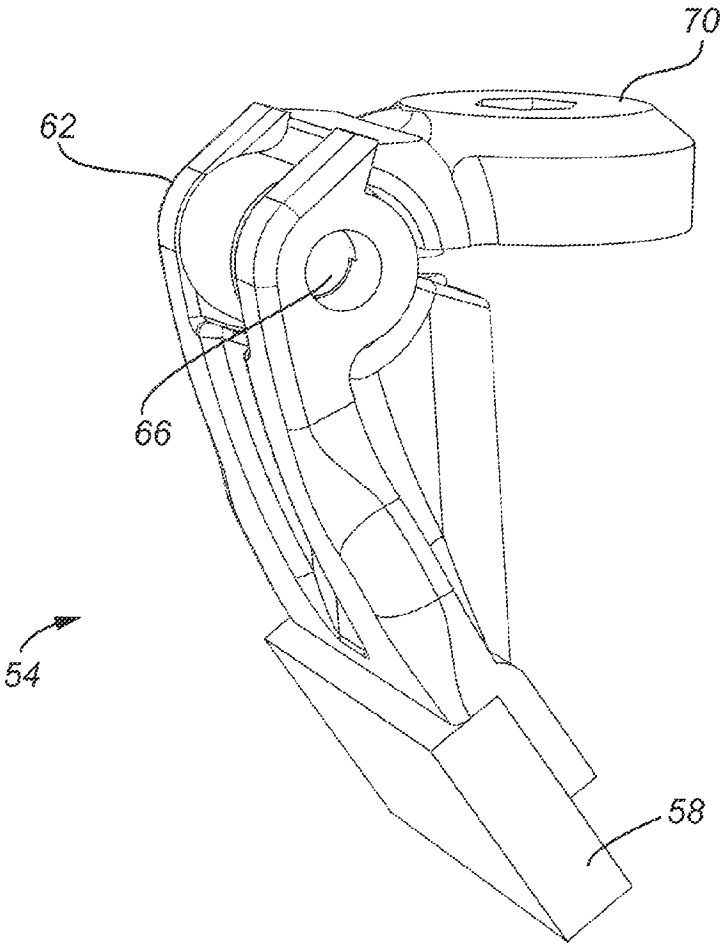
Figure 5D:
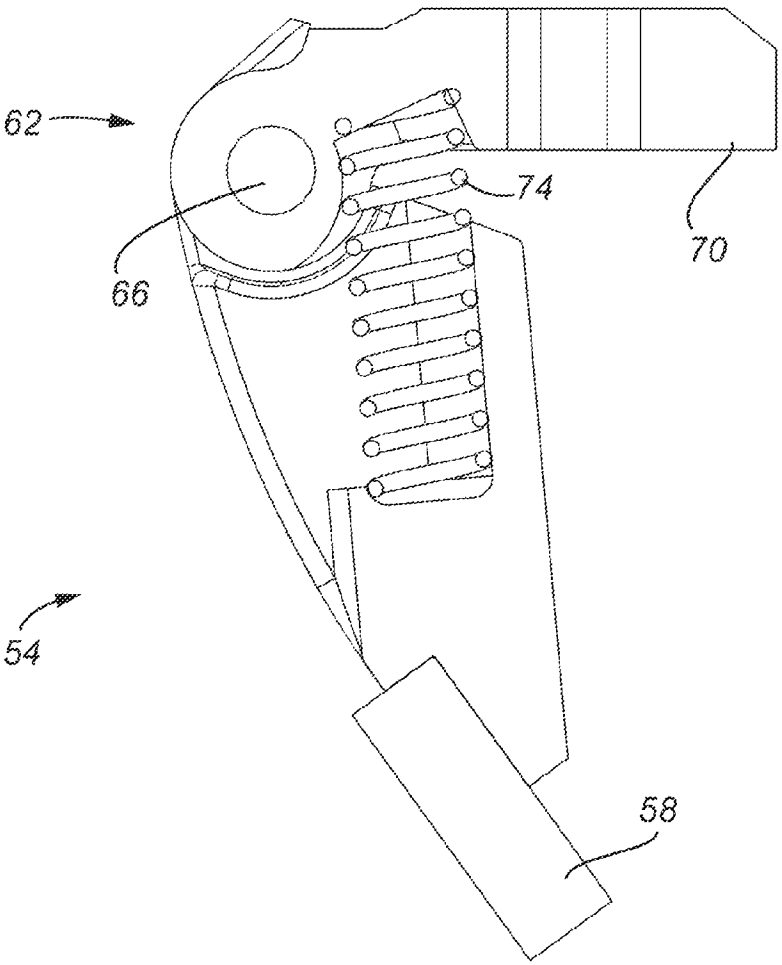

Because not materially subject to motive force and tendencies of a hose, APC 10 requires some other means for moving within a swimming pool or spa. FIGS. 1-2 thus also depict master gear 46 and gears 50, which together with feet 54 may form motive mechanism 58 (FIG. 4). As presently preferred, master gear 46 is circular (annular) and engaged by plural gears 50 (also circular) spaced equidistant about the circumference of the master gear 46. Five gears 50 are illustrated in FIG. 4, although more or fewer may be used instead. Likewise, gears 50 need not necessarily be spaced uniformly about master gear 46 if otherwise desired.

Each foot 54 may comprise tip 58, base 62, hinge 66, flange 70, and spring 74. Tip 58 is configured to contact the to-be-cleaned surface for support and motive purposes. It advantageously may be made of softer material than some or all of the remainder of foot 54, although use of such softer material is not mandatory.

Base 62 and hinge 66 mount to flange 70, which may be circular (annular) or generally so. Flange 70 in turn fixedly mounts to a gear 50. Thus, if master gear 46 turns, each gear 50 will turn and each flange 70 will turn, thereby turning foot 54. Because tip 58 normally is angled (e.g. ten degrees) to the pool floor relative to flange 70, turning foot 54 causes base 62 to pivot about the hinge 66, overcoming the bias force of spring 74 and further increasing the angle (to, e.g., twenty-five degrees) tip 58 forms relative to the pool floor as foot 54 collapses. As multiple feet 54 act in the same manner simultaneously, body 14 moves linearly ("walks") along the pool floor in a direction effectively opposite the collapse. Ceasing turning of master gear 46 stops the force causing the collapse, allowing spring 74 to return feet 54 to their extended (uncollapsed) positions. Repeating this process over time allows APC 10 to move well within a pool or spa.

Indeed, because feet 54 may turn throughout three-hundred sixty degrees of rotation, body 14 of APC 10 may move in any direction at any time—effectively "pulling," rather than being "pulled by," a connected hose. Consequently, APC 10 need not have any discernible "forward" or "rearward" movement, nor need it necessarily have any discernible "front," "rear," or "sides." This omnidirectional movement capability of APC 10 likewise allows omnidirectional collection of debris from a pool floor, increasing its functionality over conventional APCs.

Turning of master gear 46 may occur mechanically as, for example, through connection to another gearing mechanism. Electrical signals alternatively or additionally may be used, together with solenoids or other switches, to cause master gear 46 to turn. Although hydraulic APCs conventionally lack any on-board source of electrical power, such power may be provided by the equipment described in U.S. patent application Ser. No. 14/205,408, now U.S. Pat. No. 9,488,154, of van der Meijden, for example.

The foregoing is provided for purposes of illustrating, explaining, and describing embodiments of the present invention. Modifications and adaptations to these embodiments will be apparent to those skilled in the art and may be made without departing from the scope or spirit of the invention. For example, although much of the foregoing description relates to a suction-side, disc-containing, hydraulic APC, in some cases aspects of the invention may be utilized in connection with other equipment including, but not limited to, electric APCs, pressure-side hydraulic APCs, and suction-side hydraulic APCs that might not contain discs. Similarly, although gears may be employed to turn feet 54, crank arms or other devices may be used instead. Moreover, "pool," "swimming pool," and their plurals may include within their definitions spas and other water-containing vessels used for recreational or therapeutic bathing or swimming. The entire contents of the Kallenbach '593 and Kallenbach '382 patents and the van der Meijden application are incorporated herein by this reference.

What is claimed is:

1. An automatic swimming pool cleaner comprising:
a. a body having a water inlet and a water outlet; and
b. means for moving the body along a surface to be cleaned, the moving means comprising a plurality of components configured in use to (i) contact the surface and (ii) rotate in unison about axes generally perpendicular to the surface, each of the plurality of components being a collapsible foot.

2. An automatic swimming pool cleaner according to claim 1 in which the moving means is configured to permit omnidirectional movement of the body along the surface.

3. An automatic swimming pool cleaner according to claim 2 in which the moving means is configured to permit omnidirectional movement of the body along the surface without rotating the body.

4. An automatic swimming pool cleaner comprising:
a. a body;
b. a flexible disc (i) directly or indirectly connected to the body and (ii) having an underside configured in use to contact a surface to be cleaned; and
c. a plurality of feet directly or indirectly connected to the body and pivotable between extended and collapsed positions.

5. An automatic swimming pool cleaner according to claim 4 in which the plurality of feet pivot in unison between extended and collapsed positions.

6. An automatic swimming pool cleaner comprising:
a. a body;
b. a disc directly or indirectly connected to the body;
c. a plurality of feet directly or indirectly connected to the body and pivotable between extended and collapsed positions;
d. a master gear; and
e. a plurality of gears configured to engage the master gear, each of the plurality of gears being connected to a foot of the plurality of feet.

7. An automatic swimming pool cleaner according to claim 6 in which each of the plurality of feet comprises:
a. a flange connected to a gear of the plurality of gears;
b. a tip pivotable relative to the flange between extended and collapsed positions; and
c. means for biasing the tip toward the extended position.

8. An automatic swimming pool cleaner according to claim 7 in which the master gear is annular and the plurality of gears are arrayed circularly about the master gear.

9. An automatic swimming pool cleaner according to claim 8 in which the body comprises a water inlet and a water outlet.

10. An automatic swimming pool cleaner configured in use for travelling along a surface to be cleaned, comprising:
a. a body (i) having a water inlet and a water outlet, (ii) comprising means for connecting a flexible hose in fluid communication with the water outlet and an inlet of a pump, and (iii) in use defining a water flow path therethrough having at least a portion of the water flow path abutting the hose-connecting means that is generally perpendicular to the surface; and
b. a flexible disc (i) directly or indirectly connected to the body and (ii) configured to contact the surface in use.

11. An automatic swimming pool cleaner according to claim 10 in which the hose-connecting means comprises a ring or fitting.

12. An automatic, suction-side hydraulic swimming pool cleaner comprising:
a. a body (i) having a water inlet and a water outlet, (ii) comprising means for connecting a hose in fluid communication with the water outlet, and (iii) in use defining a water flow path therethrough having at least a portion adjacent the water outlet that is generally perpendicular to the surface;
b. a disc (i) directly or indirectly connected to the body and (ii) configured to contact the surface in use;
c. an annular master gear configured to rotate about an axis generally perpendicular to the surface;
d. a plurality of gears configured to (i) engage the annular master gear and (ii) rotate about axes generally perpendicular to the surface; and
e. a plurality of feet fixedly connected to the plurality of gears so as to rotate therewith, each of the plurality of feet (i) configured in use to contact the surface and (ii) comprising (A) a flange, (B) a tip pivotable relative to the flange between extended and collapsed positions, and (C) a spring for biasing the tip toward the extended position.

* * * * *